United States Patent [19]

Barkhurst

[11] Patent Number: 4,565,365

[45] Date of Patent: Jan. 21, 1986

[54] EXERCISE DEVICE

[76] Inventor: David J. Barkhurst, 3515 Road 92, Pasco, Wash. 99301

[21] Appl. No.: 491,849

[22] Filed: May 5, 1983

[51] Int. Cl.[4] ..... A63B 21/00

[52] U.S. Cl. ..... 272/73

[58] Field of Search ..... 272/73; 211/17, 22, 211/24; 280/293, 296, 299, 302; 403/325, 327, 328; D21/191, 194; D12/115, 120

[56] References Cited

U.S. PATENT DOCUMENTS

| | | | |
|---|---|---|---|
| 554,754 | 2/1896 | Webber | 272/73 |
| 3,227,496 | 1/1966 | Johnson | 403/325 |
| 3,280,439 | 10/1966 | McCarthy | 403/325 |
| 4,021,034 | 5/1977 | Olesen | 272/73 |
| 4,082,308 | 4/1978 | Hug | 272/73 |
| 4,243,342 | 1/1981 | Marto | 403/328 |
| 4,415,152 | 11/1983 | Smith | 272/73 |

FOREIGN PATENT DOCUMENTS

| | | | |
|---|---|---|---|
| 2396566 | 3/1979 | France | 272/73 |
| 17570 | of 1898 | United Kingdom | 272/73 |

*Primary Examiner*—Richard J. Apley
*Assistant Examiner*—S. R. Crow
*Attorney, Agent, or Firm*—Robert Keith Sharp

[57] ABSTRACT

A stand for supporting a bicycle to convert it to a stationary exercising device includes a frame adapted to sit on a floor or other surface. The frame carries rollers for supporting the rear wheel of the bicycle and a fixed support for the front wheel. A single supporting strut mounted on one side only of the frame has a latch at its upper end which engages the seat stem of the bicycle. Since, as stated above, only a single strut is used, the bicycle can easily be set into position on, and removed from, the stand.

5 Claims, 7 Drawing Figures

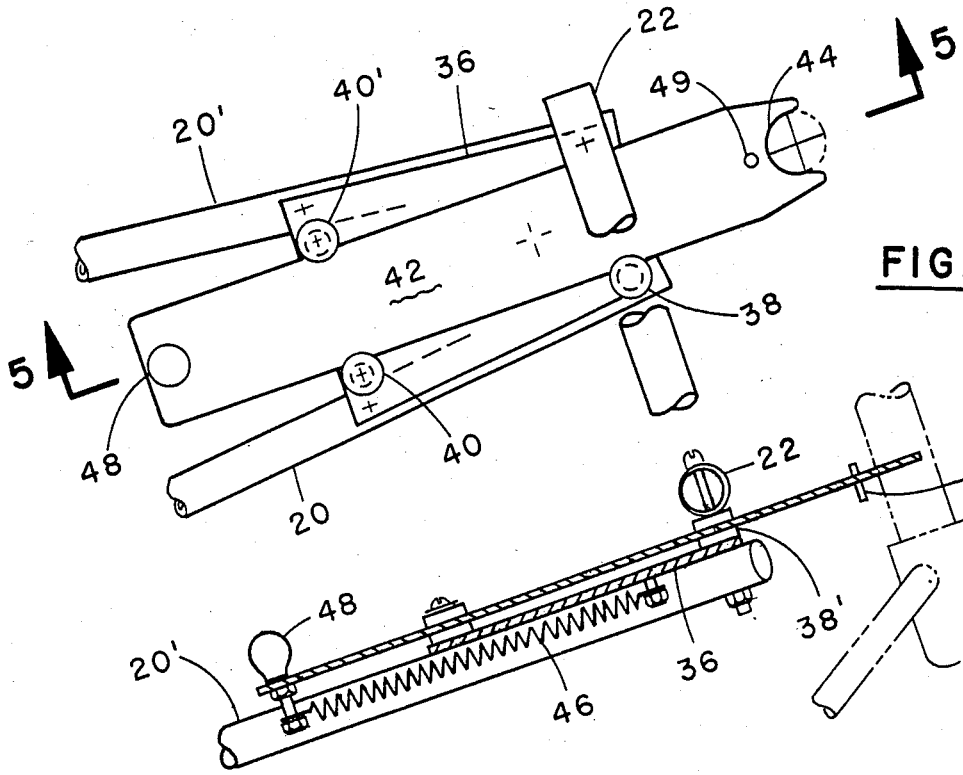
FIG. 4
FIG. 5
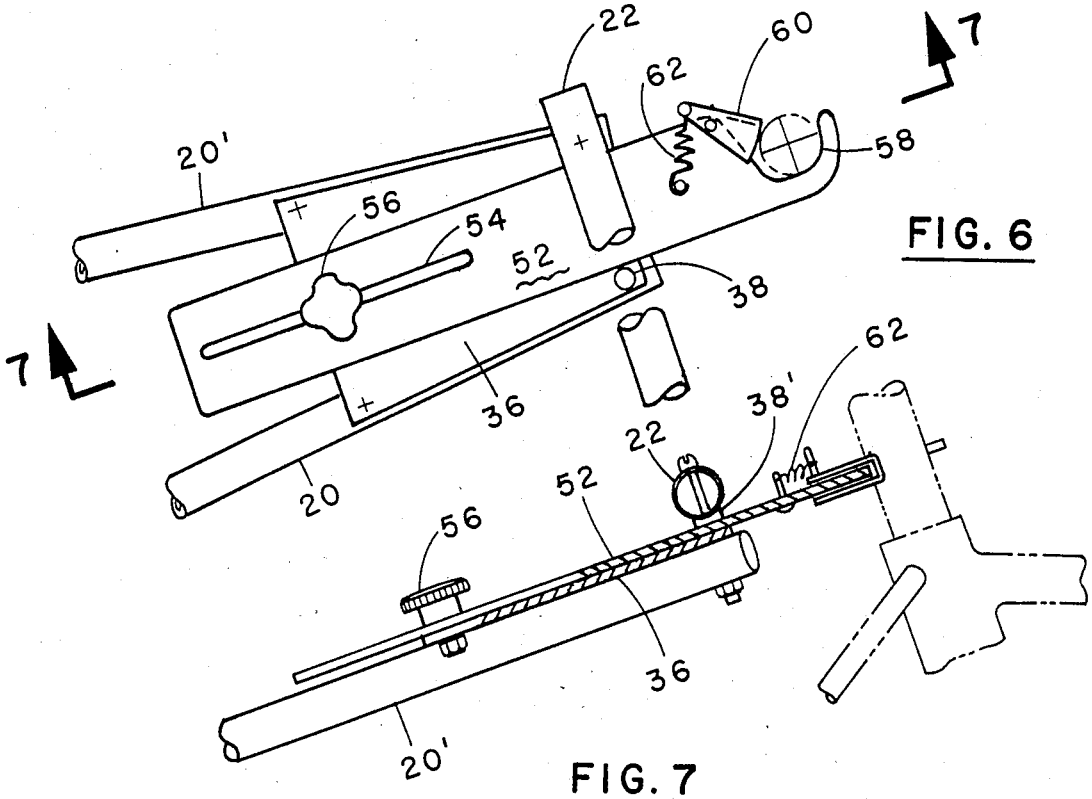
FIG. 6
FIG. 7

EXERCISE DEVICE

INTRODUCTION

This invention relates to a stand for supporting a bicycle to convert it into a stationary exercising device, which can be used indoors if desired. It is simple and inexpensive to construct, and permits the bicycle to be quickly set up or taken down without making any changes whatever in the structure of the bicycle. When the bicycle is in place the assembly is well suited to indoor use.

BACKGROUND

Many devices for converting bicycles into indoor exercise devices are on the market and still more have been patented or otherwise proposed. Those which support the bicycle in place all have, according to my observation, one or more deficiencies. Either they are expensive or difficult to set up or require modifications of the bicycle or lack stability or have more than one of the above limitations. There are other devices termed "bicycle rollers" which are simply what the term implies, sets of rollers on which the cyclist rides the bicycle and maintains his own balance. These require considerable skill on the part of the user.

SUMMARY OF THE INVENTION

My invention includes a frame adapted to sit on a floor or other surface. The frame carries rollers for supporting the rear wheel of the bicycle and a fixed support for the front wheel. A single supporting strut mounted on one side only of the frame has a latch at its upper end which engages the seat stem of the bicycle. Since, as stated above, only a single strut is used, the bicycle can be readily set into position on, and removed from, the stand.

In one modification the frame terminates at its rear end in an elastic arcuate extension which passes around and behind the rear wheel of the bicycle and connects to the latching device mentioned above. The strut is adjustable and, because of the flexible nature of the arcuate extension, the position of the latch can be readily changed to accommodate bicycles of different sizes. At its lower end the strut passes beneath the frame and extends beyond it on both sides, thus providing lateral stability for the entire system. The arcuate member provides longitudinal stability for the strut.

In the second embodiment the frame is made somewhat in the shape of the numeral 7. The strut is clamped to the cross piece at and near its free end. In this case the arcuate member is omitted. The strut is made bifurcated to provide additional stiffness.

In either modification the bicycle can be readily set on the rollers from the side of the frame opposite the strut. The latter or the arcuate extension is latched to the stem of the bicycle. The latter is pedalled in the usual manner, driving the rollers on which the rear wheel rests. Various forms of resistance devices could be coupled to the roller if desired to increase the effort of the "rider" and thus increase his exercise.

BRIEF DESCRIPTION OF THE DRAWING

In the drawing:

FIG. 4 is a plan view of a first form of latching device.

FIG. 5 is a sectional view taken on the plane indicated by line 5—5 of FIG. 4.

FIG. 6 is a plan view of a second form of latching device.

FIG. 7 is a section taken on the plane indicated by line 7—7 of FIG. 6.

DETAILED DESCRIPTION

Figure 2:
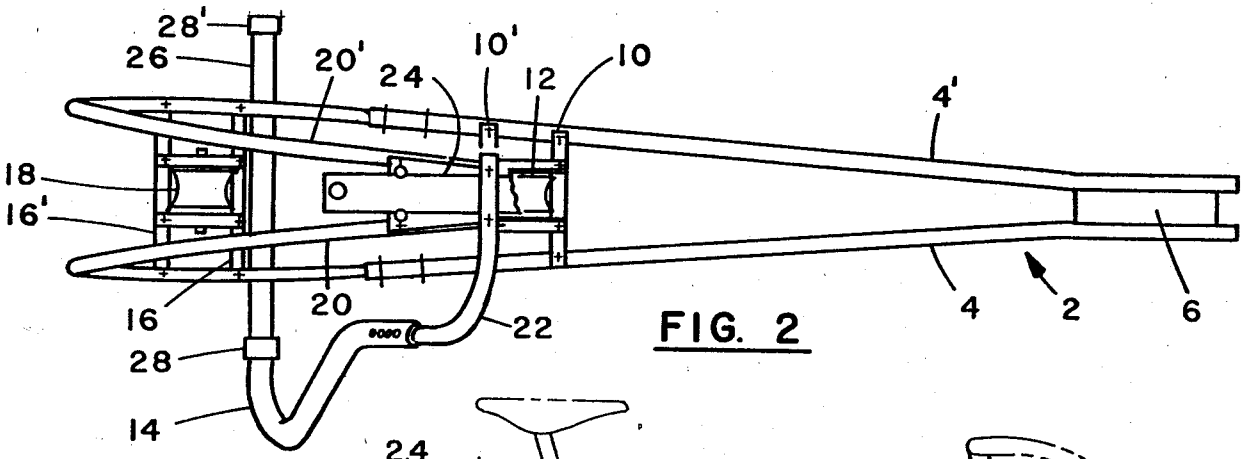
FIG. 2 is a plan view of the embodiment of FIG. 1.
Figure 1:
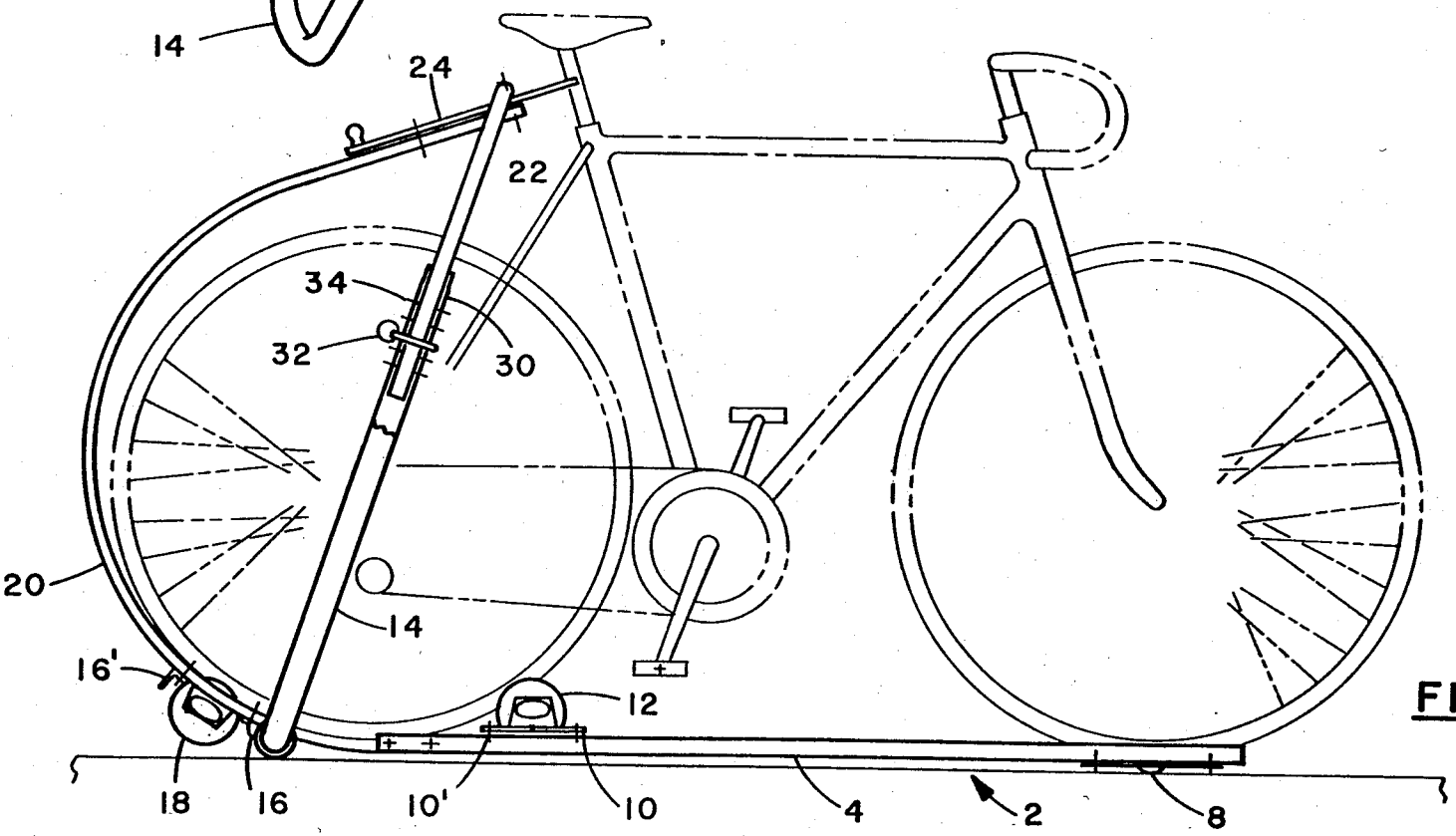
FIG. 1 is a side view of a first embodiment of my invention with a bicycle (shown in phantom lines) mounted thereon.
Figure 3:
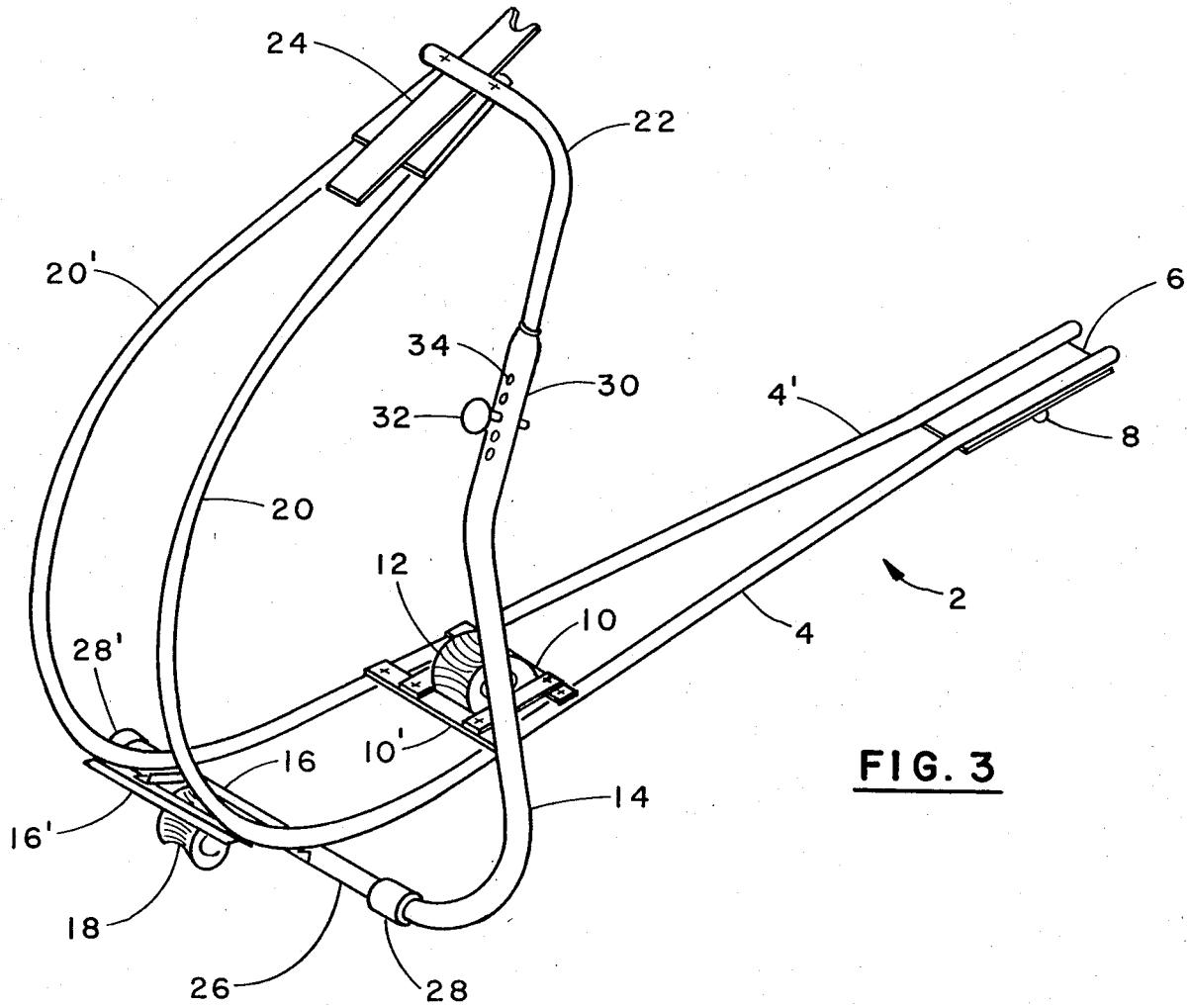
FIG. 3 is an isometric view of the embodiment of FIG. 1.

FIGS. 1, 2 and 3 show the embodiment of the invention which I prefer at present. The device includes the frame indicated generally as 2 which is formed of two tubular members 4, 4'. The forward portion of these tubular members are parallel and are secured to a pan 6 which provides support for the front wheels of the bicycle. The pan is secured to the bottom of tubes 4, 4' so that the latter form in effect a receptacle for the bicycle wheel. Pan 6 is made sufficiently long to accommodate bicycles of different sizes. Cushion 8 of rubber or other suitable material is provided beneath pan 6 to protect the floor and prevent slipping. The tubular members 4, 4' diverge rearwardly and are connected to cross pieces 10, 10' which support a roller 12 journalled in sealed ball bearings and preferably having a concave face. Still further rearwardly the tubes 4, 4' are joined to a lower strut member 14 which will be described in detail later. They are also joined to cross members 16, 16' which carry a second roller 18. It, like roller 12, is journalled in sealed ball bearings and preferably has a concave face. Members 4, 4' are now bent upwardly, forming arcuate members 20, 20'. These arcuate members have radii such that they will pass around the rear bicycle wheel. Upper strut member 22 and arcuate portions 20, 20' are connected to latching means 24 which as shown in FIG. 1 connects to the seat stem of the bicycle. The latch means 24 may take different forms and will be described in more detail later.

Returning to the members 14 and 22, the lower strut member 14 has a horizontal bottom portion 26 which extends beneath and beyond the frame 2 on both sides. It is provided with pads 28, 28' which engage and protect the floor. The length of member 26 and the distance between pads 28 and 28' is made such as to provide lateral stability to the device. The lower strut member 14 and the upper strut member 22 have a telescoping connection 30 which is provided with a pin 32 passing through holes 34 in the two strut members. Because of this type connection and the flexibility of arcuate members 20, 20' the length of the composite strut 14, 22 can be adjusted, thereby positioning the latch 24 to engage the seat stem of bicycles of varying sizes.

The form of latch which I prefer at present is shown in FIGS. 4 and 5. This embodiment includes a plate 36. This plate carries two grooved guide rollers 38, 38' beneath strut 22. It carries another pair of grooved guide rollers 40, 40' spaced rearwardly of the strut. A generally rectangular latch member 42 is mounted for reciprocation in guide rollers 38, 38', 40, 40'. At its forward end, plate 42 is provided with an arcuate notch 44 of such size as to receive standard bicycle stems, which ordinarily range in diameter from 25.4 to 27.2 mm. The plate 42 is urged forwardly by spring 46, which has one end connected to plate 36 and the other end to plate 42. Plate 42 carries an operating knob 48, which also forms a convenient means for the attachment of spring 46 as shown in FIG. 2. A stop pin 49 prevents withdrawing plate 36 too far.

To mount the bicycle for use, it is set in from the side opposite strut 14, 22 beneath the arcuate portions 20, 20'. Latch plate 42 is drawn rearwardly by knob 48, then is allowed to move forwardly to engage the seat stem of the bicycle. The device is then ready for use. The friction inherent in the bicycle mechanism and the rollers 12, 18 will usually provide sufficient resistance for the "rider" to obtain his desired exercise. If more resistance is desired the rollers 12, 18 may be provided with conventional resistance means such as fans or friction brakes. Since these are conventional, they are not shown.

In FIGS. 6 and 7 I show a different form of latching means. In this form a plate 36 is, as before, positioned between members 20, 20' and strut 22. Like plate 36 of FIGS. 4 and 5, it carries guide rollers 38, 38'. Guide rollers 40, 40' are, however, omitted. The latch plate 52 slides in guide rollers 38, 38'. It is provided with a slot 54. A locking knob 56 is threaded in plate 36 and passes through slot 54. The forward end of plate 52 is provided with an arcuate opening 58 which opens toward the side. A cam member 60 is provided with a cam surface within this opening 58. The end opposite the cam surface is connected to a spring 62. In this embodiment the movement of plate 52 serves only to adjust the position of opening 58 to the proper point to engage the seat stem of a given bicycle. It is then locked in position by locking knob 56. To mount the bicycle it is set into the frame as before, but then is simply pushed into opening 58 where the stem is gripped by cam member 60. To release the bicycle the cam member 60 is released by manually pushing it against the action of spring 62.

While I have described two embodiments of my invention in considerable detail, it will be understood that various changes can be made by persons skilled in the art. I, therefore, wish my invention to be limited solely by the scope of the appended claims.

The embodiments of the invention in which a proprietary right or privilege is claimed are defined as follows:

1. A stand for converting a bicycle into a stationary exercise device comprising:

an elongated horizontal frame of sufficient length to accommodate both the front and the rear wheels of a bicycle;

a support for the front wheel located at the front end of said frame; two rollers spaced longitudinally from each other and positioned such a distance from said support as to receive the rear wheel of said bicycle when the front wheel is on said support;

a single supporting strut extending upwardly from one side only of said frame adjacent said rollers to such a height as to reach the seat stem of said bicycle;

a latch secured to the upper end of said supporting strut constructed and arranged to releasably engage said seat stem;

said frame and strut being so constructed and arranged as to impart lateral stability to said stand and a bicycle mounted thereon;

said frame being formed of at least two laterally spaced longitudinally extending tubular members;

said support for the front wheel being mounted between said tubular members at their front end and said rollers being journaled between said tubular members;

said tubular members curving upwardly at the rear end of said frame as flexible arcuate portions with a radius sufficient to pass around, rearwardly of, and over, the rear wheel of the bicycle to a point adjacent to the seat stem of the bicycle and connected to said latch;

said supporting strut being adjustable as to length, whereby said strut and said arcuate portions cooperate to permit adjustment of the height of said latch to accommodate bicycles of various sizes.

2. A stand as defined in claim 1 wherein said strut comprises a horizontal portion positioned beneath said tubular members adjacent to said rollers and extending laterally beyond said tubular members, said horizontal portion being constructed and arranged to engage a supporting surface and provide lateral stability to said stand and a bicycle supported thereon.

3. A stand as defined in claim 1 wherein said latch comprises a stationary plate mounted between said arcuate portions of said tubular members and connected to said strut at its upper end;

guide means on said stationary plate; and a slidable plate mounted on said stationary plate and guided by said guide means for movement longitudinally of said arcuate portions, said slidable plate having a notch at its forward end of such size as to engage and retain the seat stem of a bicycle.

4. A stand as defined in claim 3 wherein said latch further comprises spring means constructed and arranged to urge said slidable plate forward; and a handle on said slidable plate for drawing it rearwardly.

5. A stand as defined in claim 1 wherein said latch comprises a stationary plate mounted between said arcuate portions and secured to said strut;

guide means on said stationary plate;

an adjustable plate mounted on said stationary plate and guided by said guide means for movement longitudinally of said arcuate portions;

means for holding said adjustable plate in a selected adjusted position;

said adjustable plate having at its forward end a notch opening laterally in the direction away from said strut, and of such size as to receive a bicycle seat stem; and cam means mounted in said notch constructed and arranged to frictionally grip a seat stem pushed into said notch.

* * * * *